US005544464A

United States Patent [19]

Dutil

[11] Patent Number: 5,544,464

[45] Date of Patent: Aug. 13, 1996

[54] COMPOSITE STEEL AND CONCRETE FLOOR SYSTEM

[75] Inventor: Marcel Dutil, Montreal, Canada

[73] Assignee: Canam Hambro, Quebec, Canada

[21] Appl. No.: 222,947

[22] Filed: Apr. 5, 1994

[51] Int. Cl.[6] ..... E04B 5/18

[52] U.S. Cl. ..... 52/330; 52/338; 52/454; 52/335; 52/329

[58] Field of Search ..... 52/329, 330, 335, 52/338, 450, 454

[56] References Cited

U.S. PATENT DOCUMENTS

| | | | |
|---|---|---|---|
| 1,791,680 | 2/1931 | Miller . | |
| 1,873,762 | 8/1932 | Hauf . | |
| 1,993,791 | 3/1935 | Kotrbaty . | |
| 2,096,629 | 5/1935 | Farrar et al. | 52/334 |
| 2,097,722 | 11/1937 | Coddington . | |
| 2,860,743 | 11/1958 | Cliff . | |
| 2,996,160 | 8/1961 | Voight . | |
| 3,093,932 | 6/1963 | Dreier et al. . | |
| 3,541,749 | 11/1970 | Troutner . | |
| 3,596,421 | 8/1971 | Miller . | |
| 3,608,267 | 9/1971 | Curran . | |
| 3,686,819 | 8/1972 | Atkinson . | |
| 3,845,594 | 11/1974 | Butts et al. . | |
| 3,945,168 | 3/1976 | Butts et al. . | |
| 3,968,616 | 7/1976 | Gostling . | |
| 4,106,249 | 8/1978 | Morton | 52/450 |
| 4,729,201 | 3/1988 | Laurus et al. | 52/334 |

*Primary Examiner*—Wynn E. Wood
*Assistant Examiner*—W. Glenn Edwards
*Attorney, Agent, or Firm*—Cushman, Darby & Cushman

[57] ABSTRACT

An improved steel and concrete floor system in which a corrugated steel deck is supported on shelves fixed to the sides of parallel spaced joists. Each joist has a top chord forming a shear connector to cause composite action to occur between the joist and a slab poured on the deck, in which the topchord is embedded. The deck acts as a form for pouring the slab, and is a permanent part of the composite floor system. The deck is fixed to the shelves either by spaced self-tapping screws or by spot welds. In the nonconcreted stage the deck and joists form a stable structure on which construction loads are safely supported.

15 Claims, 5 Drawing Sheets

COMPOSITE STEEL AND CONCRETE FLOOR SYSTEM

FIELD OF THE INVENTION

The present invention relates to a composite steel and concrete floor system constituting a significant improvement over known floor systems.

DESCRIPTION OF THE PRIOR ART

U.S. Pat. No. 3,845,594 of Nov. 5, 1974, teaches a composite steel and concrete construction in which a plurality of steel joints are arranged parallel to one another and spaced apart with steel roll or spanner bars on which either plywood or flat steel pans are positioned prior to the pouring of the concrete slab. The top chords of the joists are formed with an "S" or "Z" shape in cross-section which forms a shear connector with the concrete slab to enable full composite action to be developed. In accordance with the teachings of this prior art composite system, it is intended that the steel roll bars be removed after the concrete slab has set, and the roll bars and plywood formwork recycled for subsequent reuse.

U.S. Pat. No. 3,596,421 granted on Aug. 3, 1971, teaches a structural beam for supporting concrete flooring, used in a composite concrete and steel floor system. The structural beam provides a base part and an integral web extending upwardly from the base part. A separate inverted U-shaped cap is mounted over the upper margin of the web, extending the full length of the beam. The cap is provided with out-turned flanges extending laterally away from the web. The flanges of the cap are adapted to carry concrete supporting deck plates which extend between adjacent parallel beams. According to the teachings of the patent, a series of spaced slots are provided in the U-shaped cap and a multiple return bent or zig-zag shaped reinforcing rod having spaced transverse runs extends lengthwise of the web 10 with portions of the rod received within the slots in the cap and preferably within registering grooves in the web of the structural beam. Various techniques are used in the patent for retaining the rod in the slots. The structural beam is illustrated as being formed from an I-beam which is split longitudinally and centrally of the web to form the T-section structural beam on which the U-shaped cap is mounted.

This patent discloses the use of a corrugated deck plate spanning between adjacent joists and resting on the outwardly extending flanges of the U-shaped cap.

SUMMARY OF THE INVENTION

The present invention provides significant improvements over the teachings of the known prior art. The composite floor system of the present invention dispenses with the requirement for steel spanner bars to space the joists apart, by using a corrugated steel deck in place of the removable plywood. Joist spacing may be changed by changing the width of the steel deck sections. As will be appreciated the steel deck remains in place after the concrete of the composite floor system has been poured and set, thereby reducing the labour cost of the floor system. The top chord of the joists provides the required shear connector for composite action, without the need for additional components. The required flanges for supporting the corrugated steel deck, are also formed as part of the top chord of the joist. The corrugated deck provides lateral support for the steel components of the floor system prior to concrete setting. Other supporting non-composite beams or joists may easily be framed with the system of the present invention to support a deck. Decks may also readily be varied in depth, profile, or thickness with the system disclosed herein.

As will be appreciated by those skilled in the art, only one construction trade is required on the job-site which trade can position the joists, install the corrugated steel deck, and place the reinforcing mesh for the concrete. Following the placement of the steel deck the concrete can be poured by the usual concrete work crew. Subsequent to pouring and setting of the concrete, there is no residual requirement for further labour to remove spanner bars and formwork. Thus the overall cost of the completed composite floor system is reduced because of the reduction in the number of trades required to complete the job and the reduction in the time required for erection and pouring of the floor system. There is no need to ship rollbars to a construction site, nor to return the rollbars from the site after completion of the composite floors. A considerable cost saving can be realized by using the present invention. For remote sites, or distant projects the joists and deck may be readily packaged for shipment, and further savings for these locations are achieved.

It is an object of the present invention to provide an improved composite floor system. It is also an object of the present invention to provide an improved steel joist for use in such a composite floor system.

In accordance with the present invention a steel joist for use in a composite steel and concrete floor system has an elongated top chord having a serpentine shape in cross section, a vertical web and a bottom chord. The top chord has a first downwardly depending vertical flange terminating in a second horizontal flange, the downwardly depending flange being fastened to the web. The horizontal flange extends away from the web and an elongated angle member having a third vertical flange and a fourth horizontal flange is also provided, the third vertical flange being fastened to the web on the side of the web opposite to the first vertical flange. The fourth horizontal flange extends away from the web in alignment with the second flange whereby the second and fourth flanges form horizontal shelves to support a corrugated steel deck on either side of the joists. The decking is adapted to support the poured concrete floor with a reinforcing mesh embedded therein. The deck is secured to its shelves either with self-tapping screws or welds.

During the construction phase of the composite floor the deck which consists of the parallel spaced joists and the corrugated decking is of sufficient strength to withstand construction loads and the weight of concrete prior to setting, however, the system may be shored temporarily for especially long spans, spacings or thick concrete slabs. The corrugated steel deck is intended for permanent embedment in the concrete, then no stripping of forms or like activity is required after the concrete has poured and set. Nor are there any reusable components to be returned or reused on site.

DETAILED DESCRIPTION OF THE DRAWINGS

Figure 1:
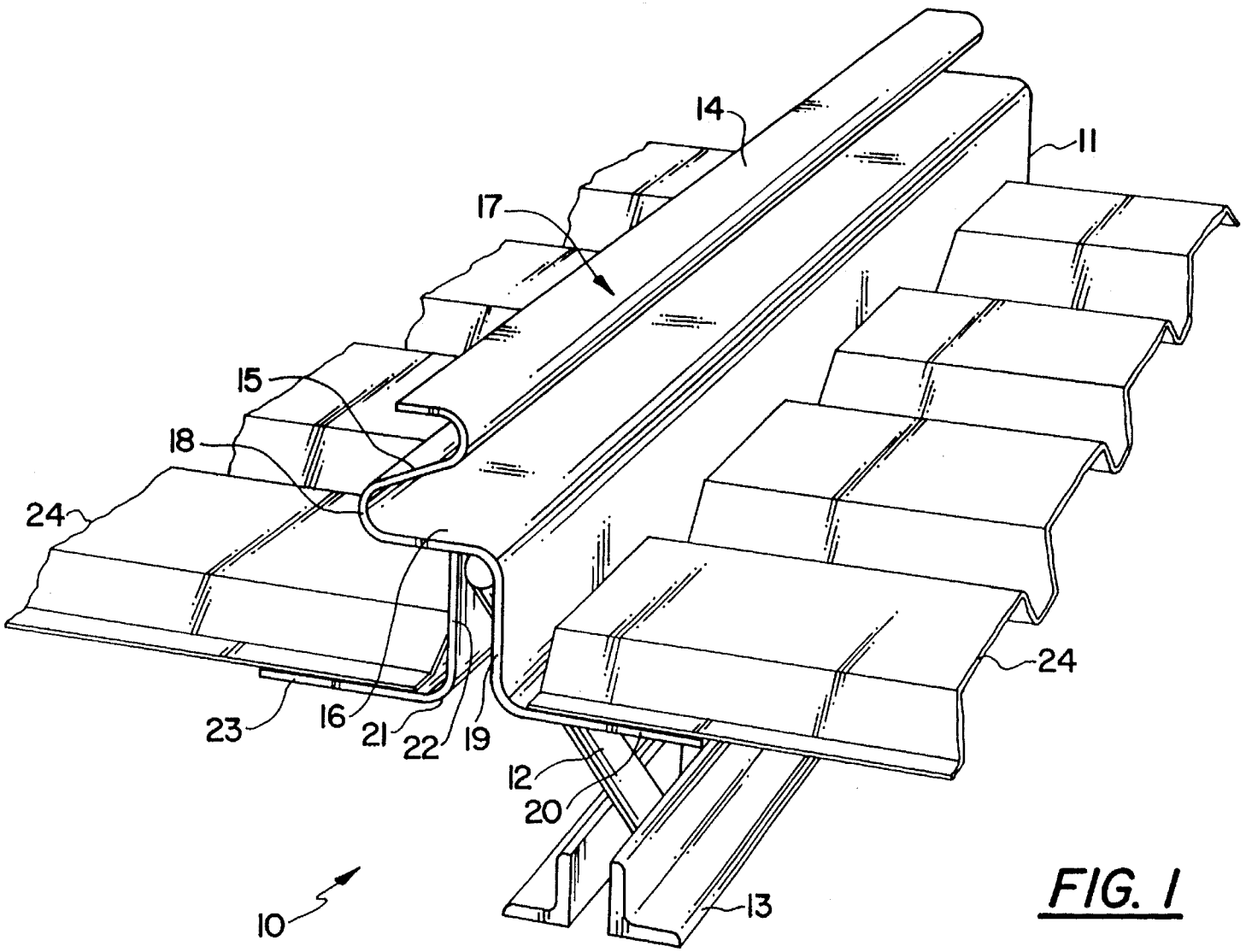
FIG. 1 perspective of an open web joist of the present invention with flanges or shelves supporting the corrugated steel deck.

In FIG. 1, there is disclosed an open web steel joist 10 having a top chord 11, a serpentine web 12 and a bottom chord 13 consisting of a pair of angles welded to the bottom of the web 12. The top chord 11 has an upper shear connector section consisting of horizontal flange 14, sloping flange 15 and horizontal flange 16, each connected with smoothly curved portions 17 and 18. The top chord 11 further includes a vertical flange 19 welded to the open web 12 which terminates in a horizontal flange 20. An angle member 21 having a vertical flange 22 and a horizontal flange 23 is welded to the top chord 11 and or the open web 12. The horizontal flanges 20 and 23 form a pair of shelves for the support of the corrugated steel deck 24. The deck is either welded to the horizontal flanges or screwed to the flanges 20 and 23 using self-tapping screws. In this condition, the joists are supported laterally by the corrugated deck, and the structure is stable during erection before the slab has been poured and set. It will be appreciated by those skilled in the art that the sections of corrugated steel deck 24 span between adjacent joists, and that such joists may be spaced up to seven feet apart with the corrugated steel deck forming a surface to carry construction loads and to support the weight of concrete prior to the floor system developing composite action.

Figure 2:
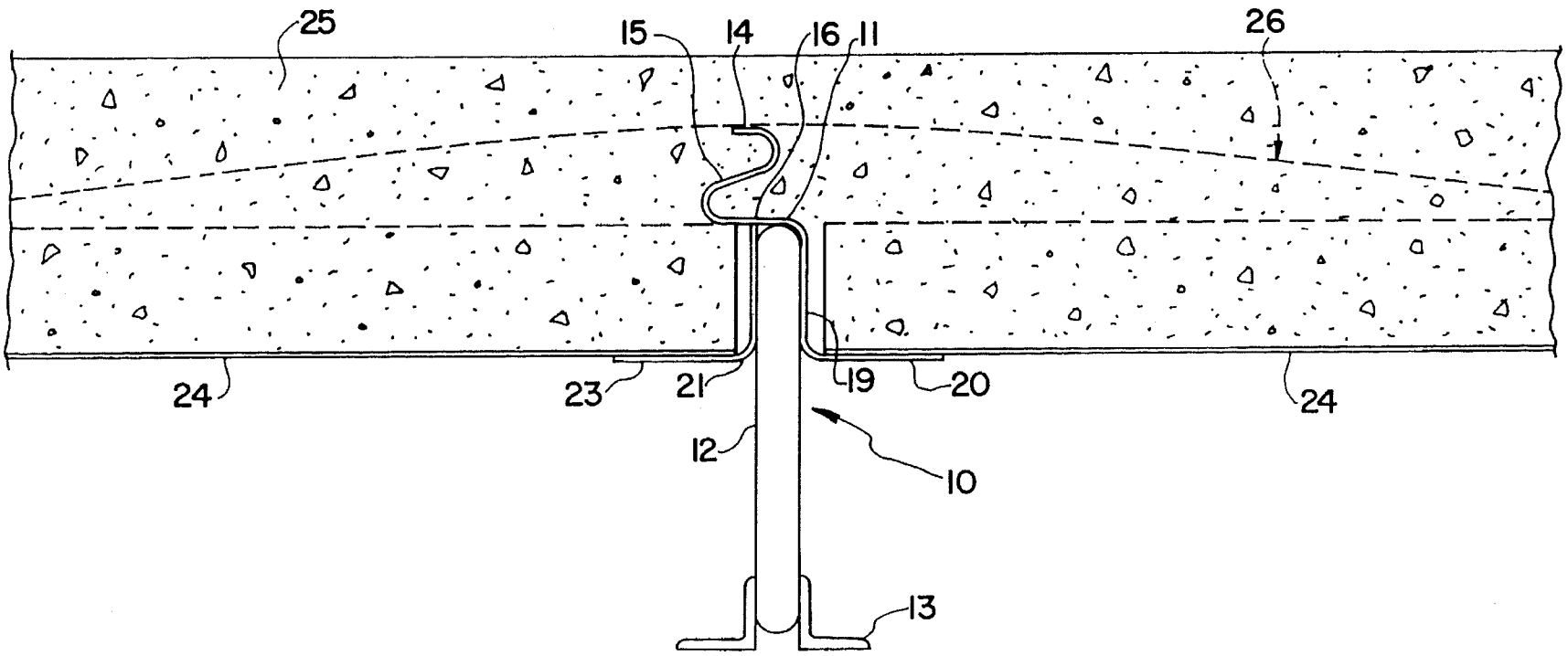
FIG. 2 is a vertical section through a composite floor system showing the open web joist, the top chord and the horizontal flanges supporting the steel decking, the poured concrete slab and the reinforcing mesh embedded in the slab.

In FIG. 2, a vertical section through a composite floor is illustrated in which an open web joist 10 has a top chord 11 a web 12 and a bottom chord 13. The top chord 11 includes the shear connector section consisting of flanges 14, 15, and 16 which are embedded in the concrete slab 25. Also embedded in the slab is reinforcing mesh 26 which may, for example, be formed of a 6" by 6" mesh, the slab for example being poured from 3,000 p.s.i. concrete. The corrugated steel decking 24 is supported on and connected to horizontal flanges 20 and 23 as discussed above. The vertical faces of the top chord 11 and the angle member 21 are welded to the open bar web by conventional MIG welding techniques.

Figure 3:
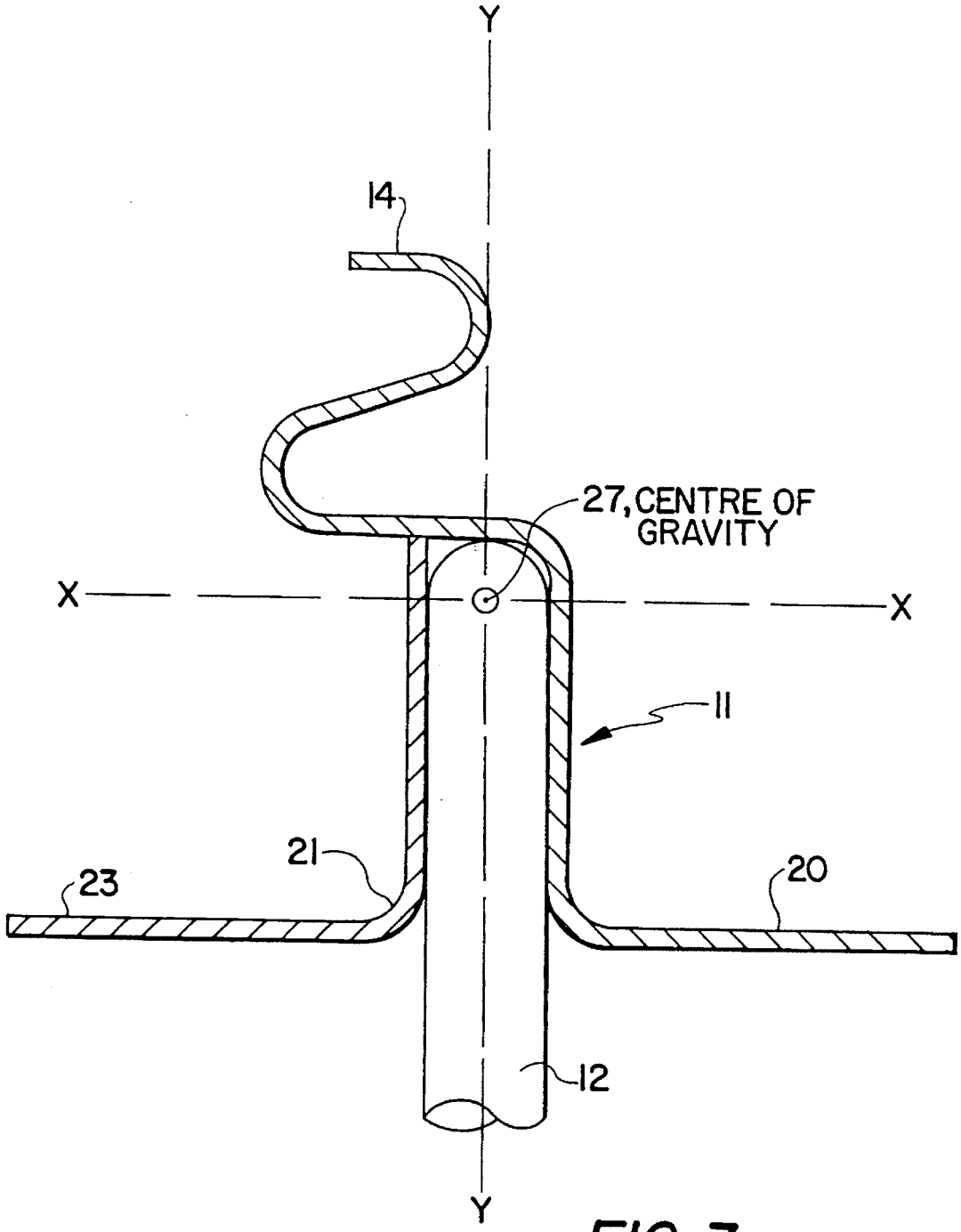
FIG. 3 is an expanded view of the top chord of FIG. 2 showing the four flanges, two vertical flanges for attachment to the open web, two horizontal flanges for supporting the corrugated steel deck, and the "S" or "Z" shaped shear connector portion intended for embedment in the concrete slab.

FIG. 3 is an enlarged vertical section of the top chord 11 and the right angle member 21, a section of the open web 12 being shown broken away for clarity. The thickness of the material utilized for the top chord may typically be 0.09" in thickness and is preferably cold-rolled steel sheet. The centre of gravity of the combined top chord is located at, or close to, point 27 and clearly indicates that the structure is stable when vertical loads are applied to the horizontal flange 14 of the top chord. Bottom bridging may be required only for long span, wide spacing, uplift, or stress reversal conditions, which would be specified by structural engineers designing special structures.

Figure 4:
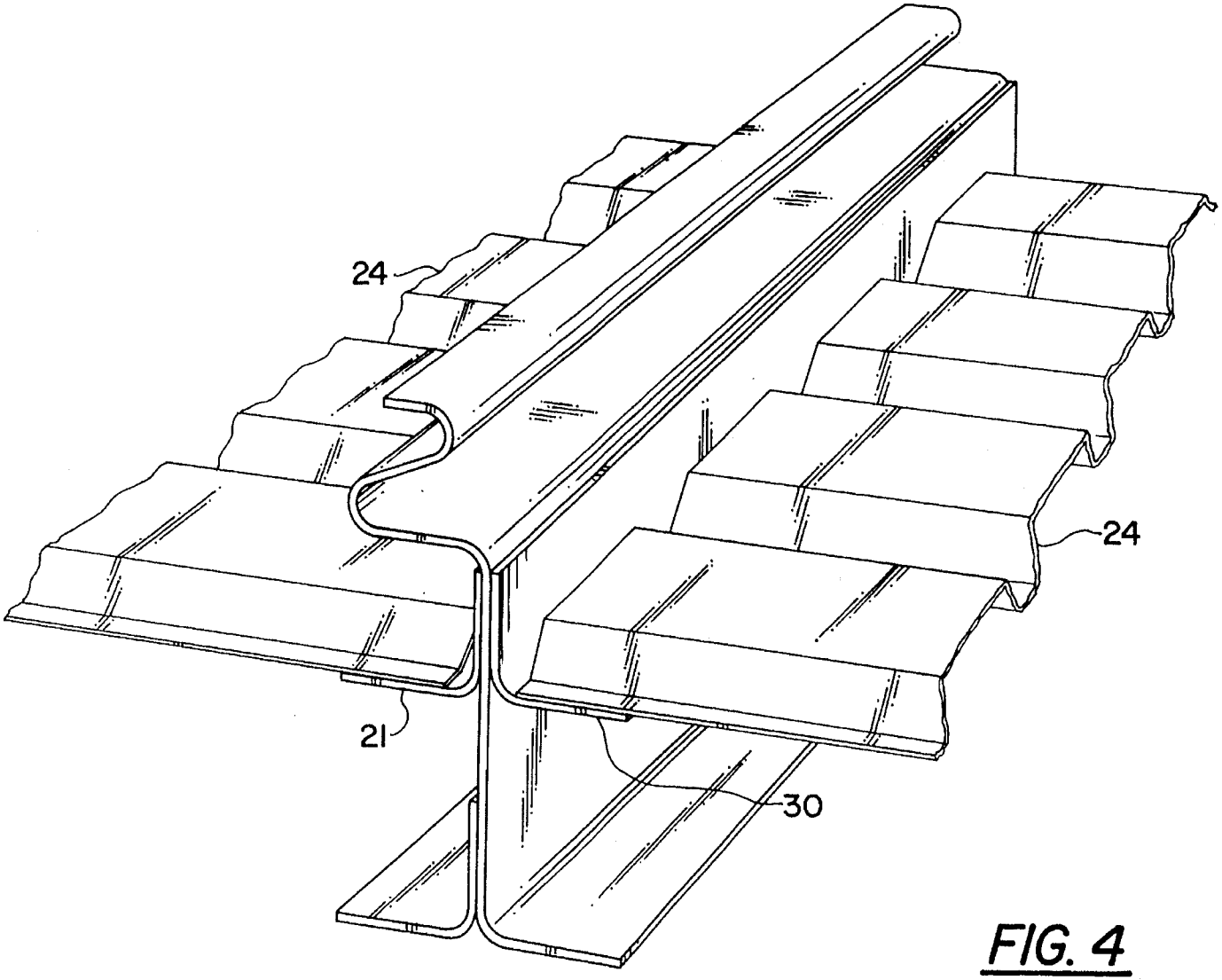
FIG. 4 is a perspective view of an alternative joist in accordance with the present invention in which the top chord and web and one flange of the bottom chord have been cold rolled from a single strip of steel, and in which the horizontal flanges supporting the corrugated steel deck are formed by right angle members attached to the web, for example, by welding. Similarly, the second flange of the bottom chord is formed with the same type of welded angle.

FIG. 4 is a perspective view of a modified form of joist in which the top chord, the web and one side of the bottom chord are formed from a single strip of cold-rolled sheet steel. In place of the horizontal flange 20 of the top chord of FIG. 3, a second angle member 30 is fastened to the web opposite the angle member 21. The second angle 30 performs the same function as the horizontal flange 20 of supporting and connecting to the corrugated steel deck 24. As before the structure includes a shear connector section surmounting the top of the vertical web which is intended to be embedded in the concrete slab to permit composite action of the floor system.

It will be appreciated by those skilled in the art of sheet steel joist construction that the joist of the present invention may be fabricated using a variety of shapes for different functions. For example, the horizontal flanges could be formed of one leg each of a pair of channel shaped members affixed back to back to the vertical flange of the top chord, and the other legs of the channel shapes would form the bottom chord of the joist. The joist of FIG. 4 could also be made with the bottom chord thereof rolled from the same strip of steel as the top chord, by forming the bottom chord as a hollow oblong shape.

Figure 5:
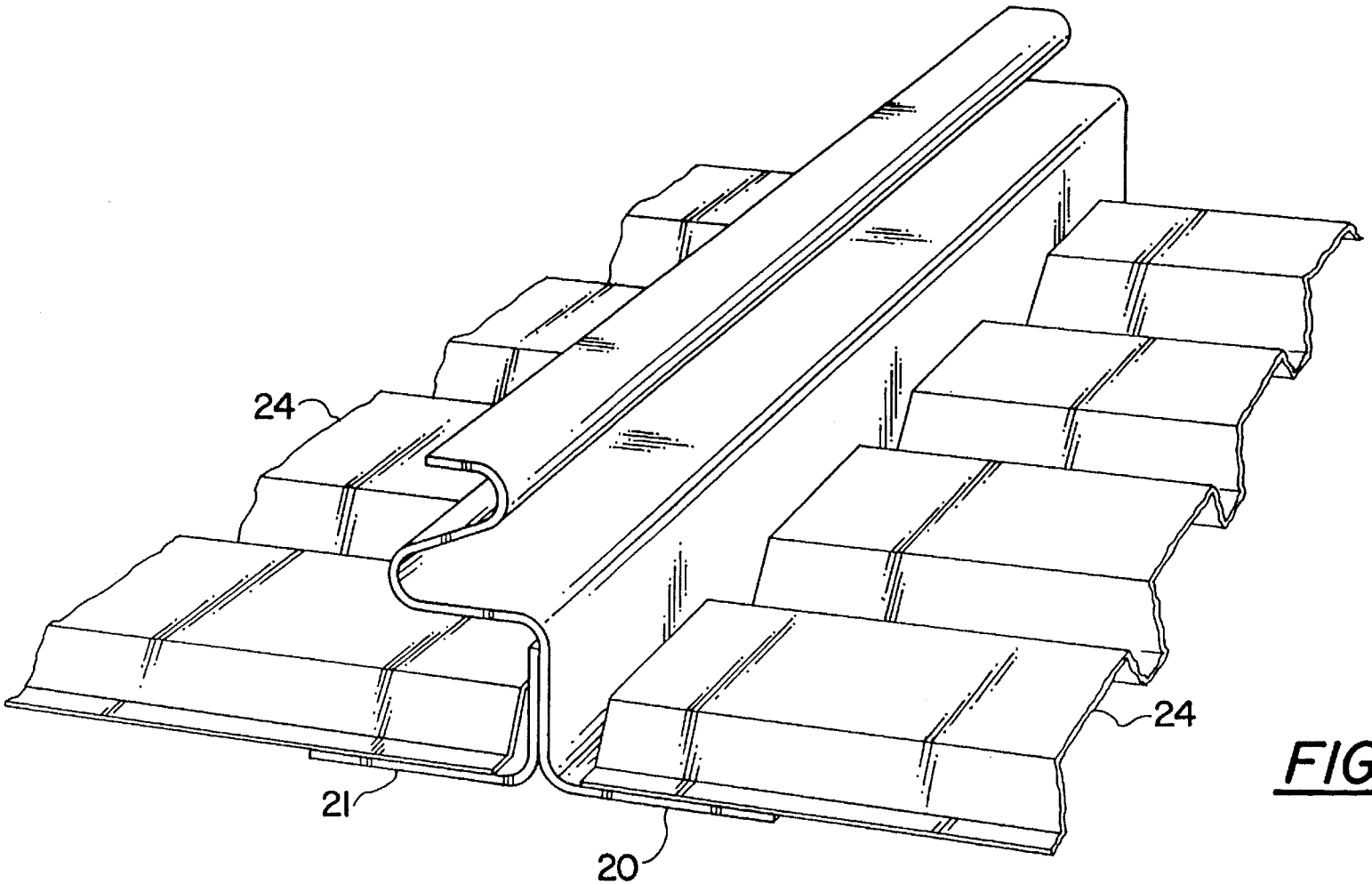
FIG. 5 is a perspective view of a short span sheet metal joist in accordance with the present invention wherein the bottom chords of the joists form the horizontal flanges that support the corrugated steel deck.

FIG. 5 illustrates an alternative form of shallow sheet steel joist in which the horizontal flanges 20 and 21 also constitute the bottom chord of the joist structure. It will be appreciated that this joist is suitable only for relatively short span applications.

The three embodiments of the sheet steel joist for use with composite floor systems as disclosed herein all provide the advantages set forth above that the complete framing system for the floor can be installed by a single metal-working trade and there is no necessity for stripping of formwork after the slab has been poured and set. There are no reusable components to the system. Thus the present invention provides an improved composite steel and concrete floor system with all of the economies of material inherent in such systems and at the same time with a reduced erection cost compared to prior composite floor systems. Other advantages will be appreciated by those skilled in the art of composite steel and concrete construction techniques.

I claim:

1. A steel joist for use in a composite steel and concrete floor, said joist comprising:

an elongated top chord including a shear connector component having a serpentine shape in vertical cross section, said shear connector component having a first horizontal component, a sloping flange component and a second horizontal component, said sloping flange extending between said first horizontal component and said second horizontal component, a vertical web, and a bottom chord, said top chord having a downwardly depending vertical first flange, terminating in horizontal second flange, said first flange being fastened to said web, said horizontal second flange extending away from said web to form a first horizontal shelf, and an elongated angle member, having a vertical third flange and a horizontal fourth flange, and said vertical third flange being fastened to said web, on the side of said web opposite said vertical first flange, said horizontal fourth flange extending away from said web to form a second horizontal shelf opposite and aligned with said first shelf at a point substantially above said bottom chord, said horizontal shelves being provided to support sections of corrugated steel deck on either side of said joist, said deck being adapted to support concrete and reinforcing mesh during the construction phase of said composite floor, the deck being intended for permanent embedment in said concrete.

2. A composite steel and concrete floor system comprising:

a plurality of joists, each having a cold-rolled steel top chord, a bottom chord and a web, said top chord including a shear connector integral therewith, and opposed horizontal flanges positioned on either side of said web intermediate said top and bottom chords, said shear connector having a serpentine shape in vertical cross section, said shear connector having a first horizontal component, a sloping flange component and a second horizontal component, said sloping flange extending between said first horizontal component and said second horizontal component, sections of corrugated steel deck supported on and fixed to said flanges on either side of each joist, a reinforcing mesh positioned over said joists and extending across said deck sections, and a concrete slab encasing said mesh and said shear connectors of said joists, and resting on said deck.

3. A composite floor system as claimed in claim 2 and further comprising means to fasten said deck sections to said flanges.

4. A composite floor system as claimed in claim 3 wherein said fastening means comprises self tapping steel screws.

5. A composite floor system as claimed in claim 3 wherein said means to fasten said deck sections to said flanges comprises welding said sections to said flanges.

6. A steel joist as in claim 1, wherein said vertical first flange extends downwardly from said second horizontal component of said shear connector, said shear connector component being disposed vertically above said vertical web.

7. A steel joist as in claim 1, wherein said first horizontal component, said sloping flange and said second horizontal component are respectfully connected with smoothly curved portions.

8. A steel joist as in claim 1, wherein said vertical web comprises an open, serpentine web disposed in a vertical plane, said first vertical flange being welded to one side of said serpentine web and said third vertical flange being welded to opposite side of said serpentine web.

9. A steel joist for use in a composite steel and concrete floor, said joist comprising:

an elongated top chord including a shear connector component having a serpentine shape in vertical cross section, said shear connector component having a first horizontal component, a sloping flange component and a second horizontal component said sloping flange extending between said first horizontal component and said second horizontal component, a vertical web, and a bottom chord, a first shelf component having a downwardly depending vertical first flange and a horizontal second flange, said first flange being fastened to said web, said horizontal second flange extending away from said web to form a first horizontal shelf, and an elongated angle member, having a vertical third flange and a horizontal fourth flange, and said vertical third flange being fastened to said web, on the side of said web opposite said vertical first flange, said horizontal fourth flange extending away from said web to form a second horizontal shelf opposite and aligned with said first shelf at a point substantially above said bottom chord, said horizontal shelves being provided to support sections of corrugated steel deck on either side of said joist, said deck being adapted to support concrete and reinforcing mesh during the construction phase of said composite floor, the deck being intended for permanent embedment in said concrete.

10. A steel joist as in claim 9, wherein said vertical web is integral with and extends downwardly from said second horizontal component of said shear connector.

11. A steel joist as claimed in claim 9, wherein said angle member is fastened to said web by self-tapping screws.

12. A steel joist as claimed in claim 9, wherein said angle member is fastened to said web by welding.

13. A steel joist for use in a composite steel and concrete floor, said joist comprising an elongated top chord having a serpentine shape in cross section, a vertical, open, serpentine web, and a bottom chord including first and second angle elements fastened to said web, said top chord having a downwardly depending vertical first flange, terminating in a horizontal second flange, said first flange being fastened to said web, said horizontal second flange extending away from said web to form a first horizontal shelf, and an elongated angle member, having a vertical third flange and a horizontal fourth flange, vertical third flange being fastened to said web, on the side of said web opposite said vertical first flange, said horizontal fourth flange extending away from said web to form a second horizontal shelf opposite and aligned with said first shelf at a point substantially above said bottom chord, said horizontal shelves being provided to support sections of corrugated steel deck on either side of said joist, said deck being adapted to support concrete and reinforcing mesh during the construction phase of said composite floor, the deck being intended for permanent embedment in said concrete.

14. A steel joist as in claim 13, wherein said an elongated top chord includes a shear connector component having said serpentine shape in vertical cross-section, said shear connector component having a first horizontal component, a sloping flange component and a second horizontal component said sloping flange extending between said first horizontal component and said second horizontal component.

15. A steel joist as in claim 14, wherein said first horizontal component, said sloping flange and said second horizontal component are respectfully connected with smoothly curved portions.

* * * * *